United States Patent [19]

Takahashi

[11] Patent Number: 4,805,298

[45] Date of Patent: Feb. 21, 1989

[54] LEVERED CONNECTOR EXTRACTOR

[75] Inventor: Ted H. Takahashi, Los Angeles, Calif.

[73] Assignee: California Institute of Technology, Pasadena, Calif.

[21] Appl. No.: 128,195

[22] Filed: Dec. 3, 1987

[51] Int. Cl.[4] ..... H01R 43/00

[52] U.S. Cl. ..... 29/764; 29/267

[58] Field of Search ..... 29/764, 762, 748, 267, 29/741

[56] References Cited

U.S. PATENT DOCUMENTS

| | | | |
|---|---|---|---|
| 3,117,370 | 1/1964 | Kauppi et al. | 29/206 |
| 3,177,567 | 4/1965 | Gehrman | 29/206 |
| 3,267,565 | 8/1966 | Stuhler | 29/206 |
| 3,357,085 | 12/1967 | Martin | 29/239 |
| 3,540,106 | 11/1970 | Goldman | 29/268 |
| 4,372,635 | 2/1983 | Waldschmidt | 29/267 |
| 4,424,625 | 1/1984 | Callahan | 29/275 |
| 4,467,512 | 8/1984 | Modes | 29/268 |
| 4,468,858 | 9/1984 | Gulberg | 29/239 |

*Primary Examiner*—Carl E. Hall

*Attorney, Agent, or Firm*—Booker T. Hogan, Jr.

[57] ABSTRACT

An extractor for separating electrical connectors is disclosed which imparts a prying force to connector elements in a plane normal to the mounting surface. The extractor comprises a lever pivotally connected to a rotatable fork that is adapted to fit under the end of a connector shell. A pair of extractors are deployed at opposite ends of a connector to pry the connector out of its mating socket gently and securely without damage to wires or connecting pins, even under crowded conditions.

14 Claims, 1 Drawing Sheet

LEVERED CONNECTOR EXTRACTOR

The invention described herein was made in the performance of work under a NASA contract, and is subject to the provisions of Public Law 96-517 (35 USC § 202) in which the Contractor has elected to retain title.

BACKGROUND OF THE INVENTION

1. Field of the Invention

The present invention relates generally to apparatus designed for extracting electrical connectors, and more particularly to levered connector extractors of the type employing mechanical advantage principals.

2. Description of Prior Art

Multipin electrical connectors are secured into mating sockets by the clamping forces exerted by individual connecting sockets on mating connector pins, and often are further secured by locking screws located at the ends of the connector shell. Removal of a connector having a large number of pins is often difficult for the unaided human hand. Sometimes resort is had to pulling the connector off by its associated cable or pigtail, despite widespread knowledge that this is considered poor practice—especially when the cable's wires are not potted to the connector. Pulling the connector off by its cable causes damage by pulling loose, or breaking individual wires.

In those instances where rows of connectors are placed on a chassis, with connectors in close proximity to each other, removal becomes even more difficult because of spatial considerations. The placement of several closely-spaced rows of connectors on a chassis or breadboard results in a dearth of room for use of human fingers, and/or conventional tools. There is thus a need for a device having a small foot print which is capable of being pivotally inserted between the respective flanges of the connector to apply a mechanical advantage through a normal plane, and thereby cause the connectors to be pried apart. Presently, the removal of individual connectors is often accomplished by the insertion of two long screwdrivers, or other unconstrained levers, under the edge of the flange which usually encircles the connector shell, and attempting to pry both levers in coordination. In some cases, rotating a flat-blade screwdriver will pry the connector loose, but in many cases there is insufficient room for this maneuver, and neighboring connectors get used as fulcrums. As a result the chances of damaging the connectors is further enhanced.

The problem is compounded in those instances where the connectors are gold plated and are used in certain aerospace applications. There is a need to remove or extract connectors without damaging the surface of the connector flanges. Scratches on the surface of the flanges promote corrosion and pitting which can and does lead to failures over prolonged time periods.

That the above-stated problem has been recognized by others is evident in that attempts to provide tools to specifically solve some of the problems discussed above are shown in U.S. Pat. No. 3,117,370 issued to J. F. Kauppi et al in 1964; in U.S. Pat. No. 3,267,564 issued to M. A. Stuhler in 1966; in U.S. Pat. No. 4,372,635 issued to John E. Waldschmidt in 1983; in U.S. Pat. No. 4,424,625 issued to Daniel L. Callahan in 1985; and in U.S. Pat. No. 4,468,858 issued to Norman B. Gulberg et al in 1984. U.S. Pat. No. 3,177,567 issued to Ivor H. Gehrman in 1956 addresses a similar issue in that it discloses a device to mate electrical connectors. However, none of the devices shown in any the Patents listed above meet the collective needs which are met by the invention as disclosed herein.

For example, the Kauppi Patent discloses a rotating fulcrum which requires a large foot print and is susceptible to imparting scratches on the surface of the flanges surrounding the connector bodies.

The Stuhler Patent discloses a device that employs a lever principle in plier-like handles to impart an extraction force to a connector. This device is similarly unsuitable for use where spatial constraints are present.

The Waldschmidt Patent discloses a lever device which similarly is unsuitable for close applications and in addition appears to inherently possess the propensity for scratching the surface of the flange as it exerts a prying force between the flanges of each connector end.

The Callahan Patent discloses a device which utilizes the wedge principal to impart a prying force to separate electrical connectors. This device is also unsuitable for use where spatial considerations are paramount and in addition the device would inherently cause the connector pins to be misaligned by the imparting of a torquing moment rather than a normal force.

While the Gulberg Patent disclosure appears to recognize the need to apply a separating force in a plane normal to the connector body and to further avoid scratching the connector flanges, the device utilizes an entirely different principle to apply the separating force and is not adapted for tight spatial applications.

The Gehrman Patent discloses a mechanical advantage tool which, upon initial inspection, appears suitable for compressing electrical connectors to form a tight fit. However, the Gehrman device has handles which preclude its use in tightly packed installations, and it does not appear to be suitable for removing or separating connectors.

Other art of interest which does not address the problem and is not adaptable for solution of the problem can be found in U.S. Pat. No. 3,357,085 issued to M. Martin; in U.S. Pat. No. 3,540,106 issued to M. J. Goldman, and in U.S. Pat. No. 4,467,512 issued to Edward E. Modes.

There is therefore a still unsolved need for an apparatus or device that is adaptable for insertion between the flanges of multipin electrical connectors in close proximity to each other to impart a normal force adequate to cause separation of said connectors without damaging said connectors or the flanges surrounding them. The device should have a small footprint, and be suitable for use with unmounted and mounted connectors. Finally the device should not be too complicated to use or expensive to make.

It is therefore an objective of the invention described below to provide an apparatus for separating multipin electrical connectors.

A further objective of the invention is to provide a apparatus for separating electrical connectors which is pivotally adapted for insertion between flanges where a small footprint is required.

A still further object of the invention is to provide a connector extractor which applies a normal force to cause separation of the connector flanges and thereby preclude damage to connector pins by bending moments, or scratching of the flanges.

And it is a still further object of the invention below to provide an inexpensive and easy to use device for separating electrical connectors which are either mounted or unmounted.

SUMMARY OF THE INVENTION

In seeking to accomplish the above stated objectives, an electrical connector extractor has been invented which utilizes the principal of a lever to impart a normal prying force to the flanges of connectors mated together in a mounted or unmounted configuration.

The device of this invention has an "L" shaped outer body which is pivotally coupled to a dogleg shaped inner lever. The lever has, at the lower end thereof, a boss projecting in a plane normal thereto that is in turn pivotally connected to a foot member which is adapted to rotate through a plane parallel to said boss, engage the flange of a connector, and thereby apply translation forces to said flange in a plane normal to said flange as said lever is compressed into said outer body.

Notwithstanding the fact that the overall size of the present invention is approximately equivalent to that of a man's thumb, a mechanical advantage, resulting from its inherent design characteristics, facilitates the application of sufficient prying forces to connector flanges without scratching or bending the connectors or parts thereof.

BRIEF DESCRIPTION OF THE DRAWINGS

The invention may be best understood upon reference to the drawings in which.

DETAILED DESCRIPTION OF THE INVENTION

Figure 1:
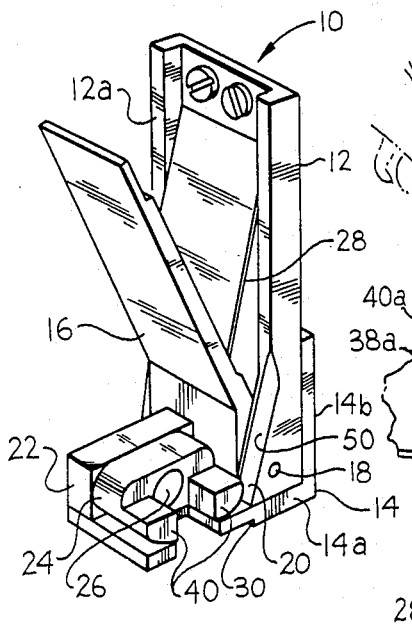
FIG. 1. is a perspective view of one embodiment of the inventon.

Referring to FIG. 1., there is shown one embodiment of the invention 10. Here, an outer body 12 is formed from a vertical channel member **12*a* and a "L" shaped base 14 which has a horizontal portion 14*a*, and a vertical portion 14*b*. A dogleg shaped inner lever 16 is pivotally connected by a pin 18 to said outer body 12 near outer edges 20 of said channel 12*a*. The dogleg shaped inner lever 16 has a horizontal boss 22 projecting therefrom, in a plane normal thereto, that is rotatively connected to a forked foot member 24 by a dowel pin 26 and secured by locking means 27. There is also shown in Figure (FIG.) 1. a biasing means 28 which separates the lever 16 from the outer body 12, and a step cut 30 in the base 14*a* which facilitates clearance of a connector flange 32** as shown in FIG. 2.

The outer body shown in FIG. 1. may be comprised of an integral member having a horizontal base and a vertical back in lieu of the "L" shaped base and channel member.

The connector extractor shown in FIG. 1. may be characterized, for convenience, as a left handed extractor in that the horizontal boss 22 is mounted proximal the left side of the lever 16 as it is viewed from the front thereof.

Figure 2:
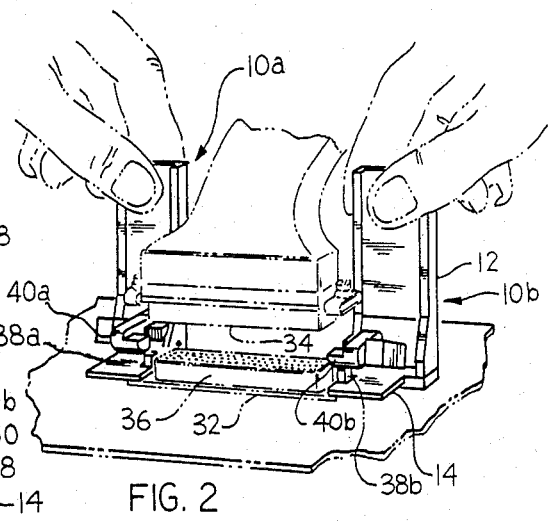
FIG. 2. is a perspective of the invention as applied to separate an electrical connector.

FIG. 2. shows a left hand extractor **10*a* and a right hand extractor 10b being used to separate an electrical connector comprised of a connector flange 32, a male portion 34, a female portion 36, and connector spacer nuts 38*a* and 38*b*. The two prongs 40*a* and 40*b* of the extractor foot member 24 are designed to clear connector spacer nuts 38** as are found in most electrical connectors.

When force is applied to the lever 16 at its top end as shown at FIG. 2. **10*a*, the lever rotates about its pin 18 thereby causing the boss 22 to raise the foot member 24 from the base 14 of the outer body 12. This movement imparts a force, multiplied by the length of the lever arm, in an upward direction from the base 14. As the boss 22 is raised, the foot member 24 remains parallel with the base 14 by rotating about its dowel pin attachment point 26**. As a result of the rotation of the foot member, the force exerted upon the male connector is normal to the plane of its connection with the female connector, and no bending moments are imparted.

Figure 4:
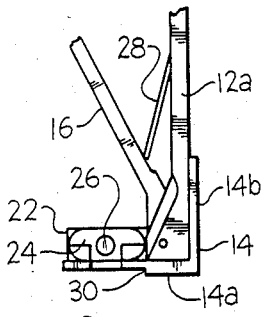
FIG. 4. is a side view of the invention in a passive state.
Figure 5:
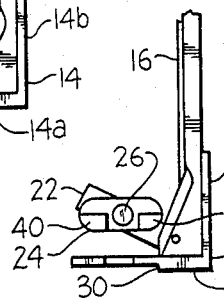
FIG. 5. is a side view of the invention as it would appear when force has been applied through its lever arm.

The afore-discussed feature of the separator may be better understood upon reference to FIG. 4. and to FIG. 5. In FIG. 4. there is shown a side elevation of the invention in an unbiased state. Note that the surface of the foot member 24 is parallel to the base 14. In FIG. 5. the lever has been compressed into the outer body thereby causing the boss 22 to raise the foot member 24 from the base 14. Note that the surface of the foot member 24 is still parallel with the base 14. It should be noted that when the boss 22 causes the foot member 24 to separate from the base 14, a small misalignment occurs between the slots of the foot member and the slots of the base. However this misalignment is slight and does not impart a straining force on the connector.

CONSTRUCTION OF PREFERRED EMBODIMENT

Figure 3:
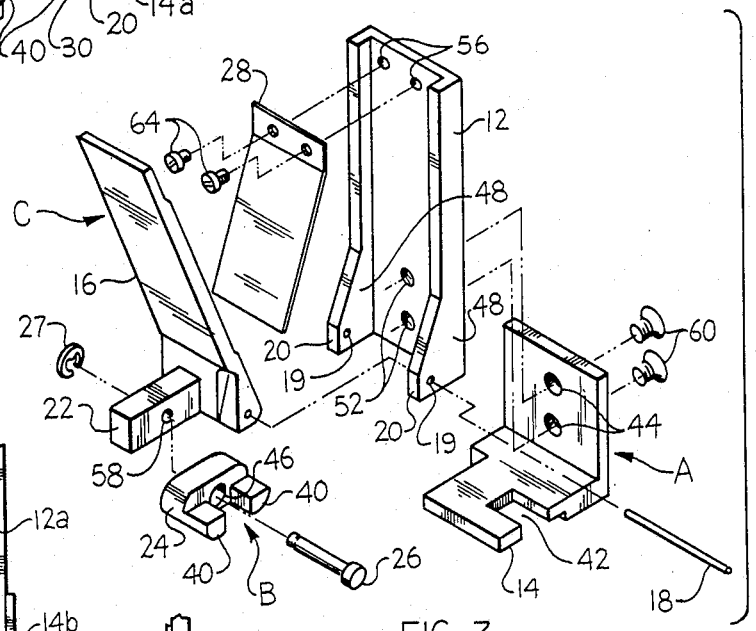
FIG. 3. is an exploded view of one embodiment of the invention showing each of its elements.

A preferred embodiment of the invention may be prepared from aluminum stock as follows:

Square up a piece of 1"×1" bar stock and; mill to form an "L" shaped base as shown in FIG. 3 at A. Turn 90° and mill slot 42 to coincide with prongs 40 of the foot member 24 as shown at B. Scribe a center line along the vertical portion of the base, and drill and tap two holes 44 along the center line as shown at A.

Form a foot member by squaring up a $\frac{3}{8}$", $\frac{1}{8}$"×$\frac{3}{4}$" rectangular bar of 6061T6 Aluminum stock, subsequently disc sanding or milling said stock with a radius cutter to dimension. Mill a slot as shown at B of FIG. 3 and step cut to form prongs 40. Scribe a center line and counter bore a hole 46 through the center of the part as shown at B.

Form an outer body from a 1"×$\frac{1}{2}$"×2.5" piece of rectangle bar of 6061T6 aluminum. Mill edges of channel to form fin like edges 48 at one end thereof, and chamfer 50 one side thereof from the end of the channel to the end of the flare. Scribe a center line along the channel and drill and tap two holes 52 at the end thereof near the fins. Drill a hole through each fin on the channel edge, and drill and tap two holes 56 at the opposite end of the channel for receiving a spring bias means 28.

Form an inner lever by squaring up a $\frac{3}{4}$"×1"×2.125" 6061T6 rectangular aluminum bar and milling as shown at C. to form a dogleg. Form a boss 22 along one edge of the lever by milling to dimension. Drill a hole 58 through the center of the boss as shown at C to receive a dowel pin 26.

Mount the channel member to the base with two machine screws 60 to form the outer body. Attach the lever 16 to the outer body 12 by extending a 303 stainless steel rod 18 through holes 19 as shown in FIG. 3, and attach the foot member to the boss with a 0.187 dia. stainless steel dowel pin 26. A biasing 0.010 spring means 28, sheared and formed from clock stock, is inserted between the lever arm and the outer body as shown in FIG. 1. with two pan head screws 64.

It should be understood that the particular materials afore-described and the means for assembling them are but one embodiment of the invention and that other materials and variations about the central concept may be utilized. Having described the invention and provided teachings for making and using the invention, the scope of that which is claimed may now be understood as follows:

I claim:

1. An electrical connector extractor for separating mated male and female multipin electrical connectors having connector bodies, each surrounded by a horizontal flange comprising an "L" shaped outer body having an upright portion and a planar base portion for insertion between and for bearing against one of said flanges pivotally coupled at said upright portion proximate to said planar base portion to an inner lever that is in turn pivotally connected to a rotating foot member, said foot member for insertion between and for engaging the other said flange of a connector to thereby apply and maintain translation forces normal to said flanges as said lever is compressed into said outer body for separation of said connectors.

2. The extractor of claim 1, wherein said outer body comprises a channel member and a planar base, and said lever is pivotally connected to said channel member near the outer edges of said channel proximal to said base, and wherein said base and said foot member each have a slot on one side thereof for slidably receiving the mounting screws of an electrical connector.

3. The extractor of claim 2, wherein said lever is a dogleg shaped lever.

4. The extractor of claim 2, wherein said lever is spring biased from said outer body, and said base has an offset on the bottom thereof for clearing the flange of the mating electrical connector and resting flush against a connector mounting panel.

5. An electrical connector extractor for separating mated male and female multipin electrical connectors have connector bodies, each surrounded by a horizontal flange comprising an "L" shaped outer body, having a planar base portion for bearing against one of said flanges, pivotally coupled to a dogleg shaped inner lever having, at a lower end thereof, a boss projecting in a plane normal thereto that is in turn pivotally connected to a foot member, said foot member for rotating through a plane parallel to said boss, and for engaging the other said flange of a connector to thereby apply and maintain translation forces to the other said flange in a plane normal to said flange as said lever is compressed into said outer body for separating said connectors.

6. The extractor of claim 5, wherein said outer body comprises a channel member and a planar base normal thereto, and said lever is pivotally connected to said channel member near the outer edges of said channel proximal to said base, and wherein said base and said foot member each have a slot on one side thereof for slidably receiving the mounting screws of an electrical connector.

7. The extractor of claim 6, wherein said lever is spring biased from said outer body, and said base has an offset on the bottom thereof for clearing the flange of the mating electrical connector and resting flush against a connector mounting panel.

8. An extractor for separating mated male and female multipin electrical connectors have connector bodies surrounded by horizontal flanges comprising an "L" shaped base for insertion between the flanges at either end of said mated electrical connectors for bearing against one of said flanges, an outer body removably attached thereto supporting a dogleg shaped lever having a boss projecting from the lower end thereof, pivotally mounted within said outer body and a foot member rotatably attached to said boss, said foot member for engaging the other said flange of a connector to thereby apply and maintain translation forces thereto in a plane normal to said flanges as said lever is compressed about its pivot point to cause separation of said connectors.

9. The connector extractor of claim 8, wherein said base is provided with a slot on one side thereof and said foot member is forked to mate with said slotted base and thereby receive mounting screws found at each end of said connector.

10. The connector extractor of claim 8, wherein said outer body is a channel having, at its lower end, edges which flare into fin like projections on each side thereof, and wherein said lever is pivotally connected to said fin like edges proximate to said base and spring biased with respect to said outer body.

11. An extractor for separating mated male and female multipin electrical connectors having connector bodies, each surrounded by a horizontal flange comprising an "L" shaped support member having a upright portion integral with a planar base portion, said planar base portion for bearing against one of said flanges being substantially parallel to said horizontal flanges and positioned for insertion between the flanges of said mated electrical connectors, a dogleg shaped lever having a horizontal boss projecting from the lower end thereof pivotally mounted to the upright portion of said "L" shaped support member at said planar base portion, and a foot member rotatably attached to said boss, said foot member for engaging the other said flange of a connector to thereby apply and maintain translation forces thereto in a plane normal to said flanges as said lever is compressed about its pivot point to move the other said horizontal flange to cause separation of said electrical connectors.

12. The extractor of claim 11, wherein said base is provided with a slot on one side thereof and said foot member is forked to mate with said slotted base and thereby receive mounting screws found at each end of said connector.

13. The extractor of claim 11, wherein said outer body is a channel having, at one end thereof, edges which flare into fin like projections on each side thereof, and wherein said lever in pivotally connected to said fin like projections proximate to said base.

14. The extractor of claim 11, wherein said base is provided with an offset at the bottom thereof for receiving the flange of a connector mounted on a panel, and wherein said lever is spring biased with respect to said outer body.

* * * * *